United States Patent [19]

Ishigaki

[11] 4,266,667

[45] May 12, 1981

[54] PACKAGE OF MECHANICAL PENCIL REFILL LEADS

[75] Inventor: Kazumi Ishigaki, Hirakata, Japan

[73] Assignee: Sakura Color Products Corporation, Osaka, Japan

[21] Appl. No.: 77,121

[22] Filed: Sep. 19, 1979

[30] Foreign Application Priority Data

| | | | |
|---|---|---|---|
| Oct. 23, 1978 | [JP] | Japan | 53-146242[U] |
| Dec. 28, 1978 | [JP] | Japan | 53-179765[U] |
| Dec. 29, 1978 | [JP] | Japan | 53-180666[U] |
| Dec. 29, 1978 | [JP] | Japan | 53-180667[U] |
| Feb. 24, 1979 | [JP] | Japan | 54-23219[U] |

[51] Int. Cl.[3] ..... B65D 83/02; B65D 85/20

[52] U.S. Cl. ..... 206/469; 206/634; 206/443; 206/214

[58] Field of Search ..... 206/214, 443, 441, 461, 206/462, 469, 45.33, 634

[56] References Cited

U.S. PATENT DOCUMENTS

| | | | |
|---|---|---|---|
| 2,927,689 | 3/1960 | Look, Jr. | 206/441 |
| 3,074,540 | 1/1963 | Beich et al. | 206/469 |
| 3,075,639 | 1/1963 | Lingley | 206/469 |
| 3,165,234 | 1/1965 | Conklin et al. | 206/469 |
| 3,372,802 | 3/1968 | Repko | 206/469 |
| 3,472,368 | 10/1969 | Hellstrom | 206/469 |
| 3,648,891 | 3/1972 | Katz et al. | 206/443 |
| 3,815,734 | 6/1974 | Kruckel | 206/443 |

*Primary Examiner*—William T. Dixson, Jr.
*Attorney, Agent, or Firm*—Armstrong, Nikaido, Marmelstein & Kubovcik

[57] ABSTRACT

A multiple package unit consisting of a plurality of packages of mechanical pencil refill leads is formed of first and second sheet materials. The first sheet material includes a plurality of integral parallel sections each shaped to provide an elongated swelling on one side, a corresponding recess in the other side and a substantially flat marginal flange integral with the swelling and extending outwardly therefrom. The sections of the first sheet material form separable containers, respectively. Refill leads are housed in the recess in each container. The second sheet material includes a plurality of flat and integral sections each extending over a recess in one of the containers and secured to the marginal flange thereof to form a closure of the container. Each container cooperates with the leads therein and with associated closure member to form a package which is separable from an adjacent package by means of score line formed in at least the first sheet material. Each container is provided with a weakening cut formed in the swelling adjacent to one end thereof to facilitate opening of the package.

6 Claims, 14 Drawing Figures

PACKAGE OF MECHANICAL PENCIL REFILL LEADS

BACKGROUND OF THE INVENTION

1. Field of the Invention

The present invention relates to a package of mechanical pencil refill leads.

2. Description of the Prior Art

In the past, mechanical pencil refill leads were contained in generally tubular containers each having an open end openably closed by a cap. Each time when a mechanical pencil becomes empty, a required number of the refill leads was discharged from the container and introduced into the mechanical pencil. The refilling operation was troublesome and tended not only to soil the operator's fingers but also to cause break and/or dropping of the leads.

In order to eliminate the shortcomings of the prior art refill lead container discussed above, there has been deviced refill lead cartridges each comprising a container and a batch of refill leads housed therein. The cartridge is adapted to be inserted into a lead barrel of a mechanical pencil with one end of the cartridge being open so that the leads are successively fed from the cartridge to the writing tip of the pencil. This type of refill lead container, however, has a shortcoming that the size of the container is limited by the size of the lead barrel of mechanical pencils which are designed for use with the cartridges. Thus, a cartridge becomes empty in a relatively short period of time and, accordingly, cartridges must be frequently replaced. In addition, because a mechanical pencil is refilled with leads only after the leads in a cartridge in the pencil have all been spent, a trouble is encountered that the pencil becomes empty suddenly or unexpectedly.

SUMMARY OF THE INVENTION

It is an object of the present invention to eliminate the shortcomings of the prior art discussed above.

It is another object of the present invention to provide a novel and improved package of mechanical pencil refill leads comprising a container which can be manufactured at a low cost and can be used as a dispenser for mechanical pencil refill leads and which is disposable after use.

It is a further object of the present invention to provide a package of the class specified above and which presents an attractive and aesthetic appearance when put on sale.

According to one feature of the present invention, there is provided a package of mechanical pencil refill leads, comprising a container formed of a plastically deformable first sheet material shaped to provide an elongated swelling on one side of the sheet material, a corresponding recess in the other side of the sheet material and a substantially flat marginal flange integral with said swelling and extending outwardly therefrom, mechanical pencil refill leads disposed in said recess, and a substantially flat closure member of a second sheet material extending over said recess to close the same and secured to said marginal flange, said container being provided with a cut formed in said swelling adjacent to one end thereof to facilitate easy opening of said package.

The container may have a generally arcuate cross-section. The cut may be either in the form of a slit formed in the wall of the swelling or in the form of a groove formed in the swelling. The marginal flange adjacent to at least one of the ends of the elongated swelling is extended in the longitudinal direction of the swelling to provide the package with a substantially flat end. The portion of the elongated swelling adjacent to the substantially flat end of the package may preferably be divergent to the substantially flat package end. The first and second sheet materials may be made of a metal, such as aluminium and tinned plate, or of a plastics material, such as polyvinyl chloride and polypropylene. Preferably, the first sheet material may be made of aluminium while the second sheet material may be made of transparent polyvinyl chloride.

According to another feature of the present invention, there is provided a multiple package unit consisting of a plurality of package of mechanical pencil refill leads, comprising a first member of a plastically defoamable first sheet material including a plurality of integral parallel sections each shaped to provide an elongated swelling on one side of the sheet material, a corresponding recess in the other side of the sheet material and a substantially flat marginal flange integral with said swelling and extending outwardly therefrom, said sections forming separable containers, respectively, mechanical pencil refill leads disposed in the recess in each of the containers; and a substantially flat second member of a second sheet material including a plurality of substantially flat integral sections each coextensive with one of said containers and secured to the marginal flange of the container to form a closure of the container, each of the containers cooperating with the leads disposed therein and with the associated closure to form a package, at least one of said first and second members being provided with means facilitating easy separation of the packages, the container of each package being provided with a cut formed in its swelling adjacent to one end thereof to facilitate easy opening of the package.

The above and other objects, features and advantages of the present invention will be made more apparent by the following description with reference to the accompanying drawings.

DESCRIPTION OF PREFERRED EMBODIMENTS

Figure 1:
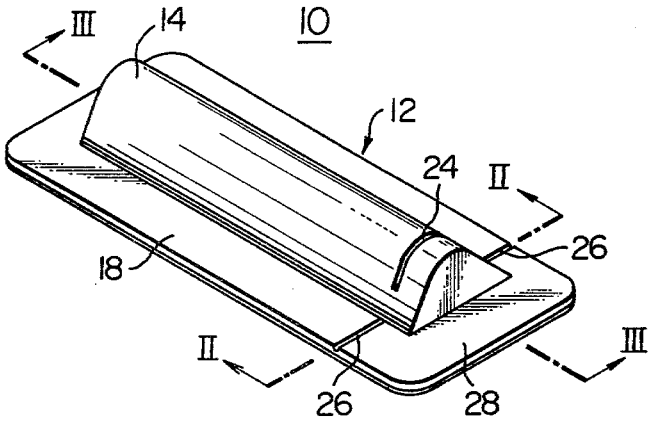
FIG. 1 is a perspective view of a first embodiment of a package of mechanical pencil refill leads according to the present invention.
Figure 2:
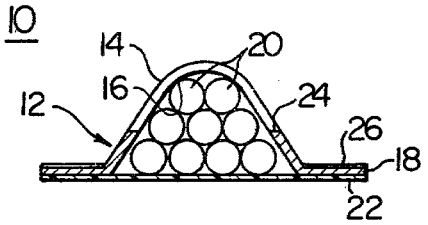
FIG. 2 is a cross-sectional view of the package shown in FIG. 1 as taken along line II—II in FIG. 1.
Figure 3:
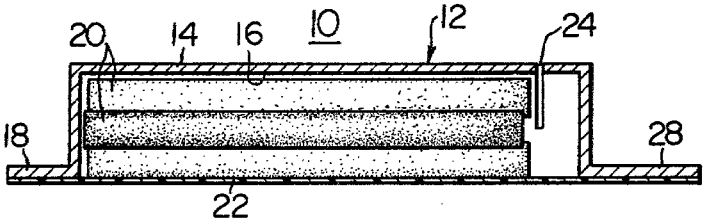
FIG. 3 is a longitudinal view of the package shown in FIG. 1 as taken along line III—III in FIG. 1.

Referring first to FIGS. 1 to 3, first embodiment of the package of mechanical pencil refill leads is generally designated by reference numeral 10 and comprises a container 12 of a first sheet material which is shaped to provide an elongated bulge or swelling 14 on one side of the sheet material, a corresponding recess 16 in the other side of the sheet material and a substantially flat marginal flange 18 which is integral with the swelling 14 and extends outwardly therefrom. A plurality of refill leads 20 are housed in the recess 16, as best seen in FIG. 2. In the illustrated embodiment of the invention, the sheet material which forms the container 12 is made from aluminium and may have a thickness of from 0.2 to 0.5 mm.

A substantially flat closure member 22 of a second sheet material, which is preferably made from a plastics material, extends over the recess 16 to close the same and is secured to the marginal flange 18 of the container 12 by means of an adhesive. The second sheet material may have a thickness of from 0.01 to 0.5 mm. The closure member 22 is co-extensive with the container 12.

A cut, which is in the form of a slit 24, is formed in the wall of the swelling 14 adjacent to one end thereof and extends substantially perpendicularly to the longitudinal axis of the swelling 14, as best seen in FIG. 3. The container 12 is also provided with lateral or transverse grooves 26 formed in the flange 18 and aligned with the ends of the slit 24 in the lateral direction of the container. The slit 24 and the lateral grooves 26 are provided to weaken the container so as to facilitate easy opening of the package 10. It will be noted that each end of the slit 24 is spaced from the inner end of an adjacent or associated lateral groove 26 so that the material of the sheet metal is left between the slit 24 and the grooves 26 to provide the container 12 with a proper stiffness or self-supporting property. The lateral grooves 26 are not essential for the invention and may be omitted in some cases. In the case where the container 12 is provided with the weakening lateral grooves 26, the depth of the grooves may be determined based on the material from which the container is made and also on the material of the backing or closure member 22. The container-weakening slit 24 should be positioned adjacent to one end of the swelling 14 to prevent the leads 20 in the container from being broken when the container is broken along the slit to open the package 10.

When it is required to open the package 10 to discharge the leads 20 therefrom, the major part of the package 10 will be held by one hand of an operator or user. Then, the other or free end portion of the package 10 will be angularly moved or bent reciprocally a few times about the lateral grooves 26 relative to the major part of the package 10 until the container is broken along the lateral grooves and along extensions of the slit 24 to the grooves 26. Thus, the package 10 is opened and ready for refilling operation of a mechanical pencil P, as shown in FIG. 4.

Figure 4:
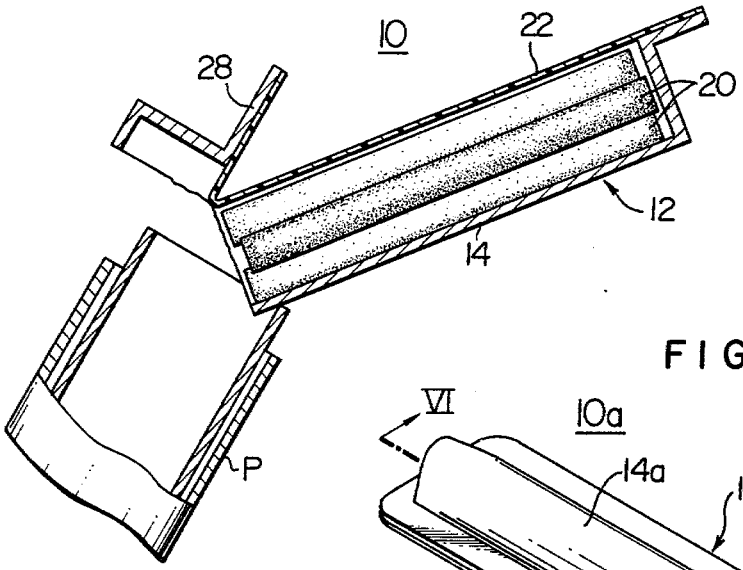
FIG. 4 illustrates in section the package of the first embodiment when opened to discharge refill leads therefrom into a mechanical pencil.

It will be seen in FIG. 4 that the container 12 is completely broken whereas the closure member 22 is not broken but simply bent and supports or carries the broken end of the container 12. This is advantageous in that the broken end of the container is prevented from being dropped and scattered. This advantageous result can be obtained because the closure member 22 is made of a flexible sheet of a plastics material, such as polyvinyl chloride. The plastics sheet material may preferably be transparent to give the package 10 an attractive and aesthetic appearance and to allow the refill leads to be seen from outside the package.

The container 12 and the closure member 22 may alternatively be both made of a plastics material or materials. However, it is most preferred that the container 12 is made of aluminium sheet and the closure member is made of transparent polyvinyl chloride. This is particularly true with the case where the package 10 is of such a small size as to contain as many as 4 to 8 leads. With such a small size of package, the container 12 should be sufficiently strong and stiff enough to protect the leads therein and, at the same time, should be easily broken when the package 10 is opened. Aluminium sheet is most suited for this purpose. The use of aluminium sheet provides a further advantage that prints made on a surface of the aluminium sheet before it is subjected to shaping or drawing operation are less liable to be distorted than in the case where a plastics sheet is used.

It will be also seen in FIGS. 1 to 4 that the marginal flange 18 at the end of the package 10 which is adjacent to the container-weakening slit 24 is extended in the longitudinal direction of the package to provide the same with a substantially flat and relatively wide end 28. This wide end 28 advantageously enables a user to easily pinch this end of the package by his fingers when he is required to open the package 10. In addition, the flat and wide end 28 provides a surface on which some notes, marks or instructions may be printed. Moreover, a small aperture may be formed in the flat end 28 for engagement with a hook by which the package 10 may be suspended in a shop for display purpose.

Figure 5:
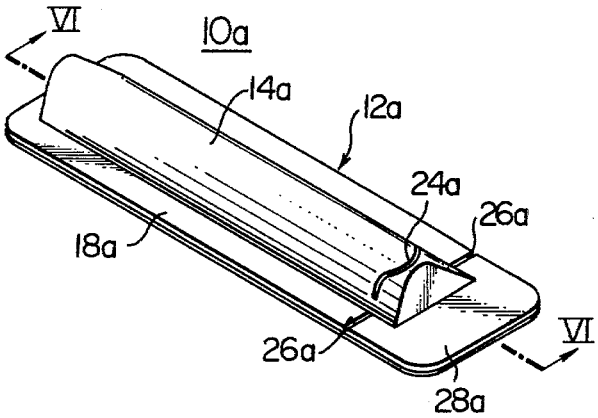
FIG. 5 is a perspective view of a second embodiment of the package according to the present invention.
Figure 7:
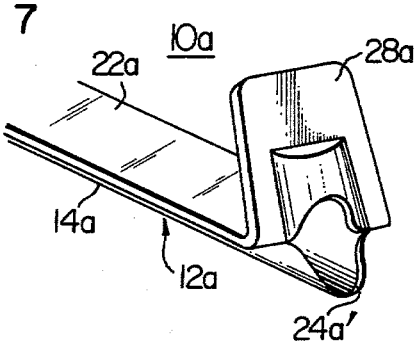
FIG. 7 illustrates in section the package of the second embodiment when the package is opened.
Figure 6:
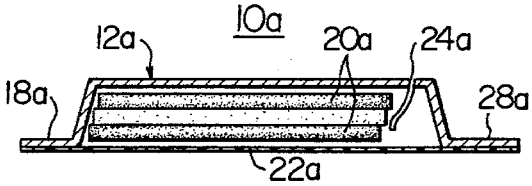
FIG. 6 is a sectional view of the package shown in FIG. 5 as taken along line VI—VI in FIG. 5.

A second embodiment 10*a* of the package according to the present invention is shown in FIGS. 5, 6 and 7 wherein the parts similar to those of the first embodiment 10 are designated by similar reference numerals followed by "a". The second embodiment 10*a* is differentiated from the first embodiment 10 in that the container-weakening slit 24*a* formed in the swelling 14*a* extends obliquely with respect to the longitudinal axis of the swelling, as best seen in FIG. 6, and has it opposite ends slightly curved and directed towards the lateral grooves 26*a* formed in the marginal flange 18*a*. The container-weakening slit 24*a* of the discussed design is advantageous in that, when the wide end 28*a* is bent about the grooves 26*a* relative to the major part of the package 10*a*, as shown in FIG. 7, the resultant edge 24*a*' of the major part of the package 10*a* presents a "pouring edge" which resembles the pouring edge of a pot or the like and which can conveniently be inserted into the open end of a lead barrel of a mechanical pencil to guide or "pour" leads from the package 10*a* into the pencil.

Figure 8:
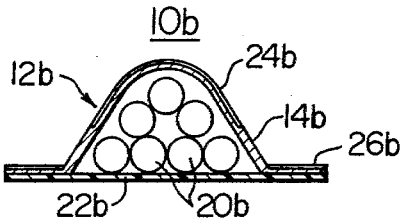
FIG. 8 is a cross-sectional view of a third embodiment of the package of the present invention.
Figure 9:
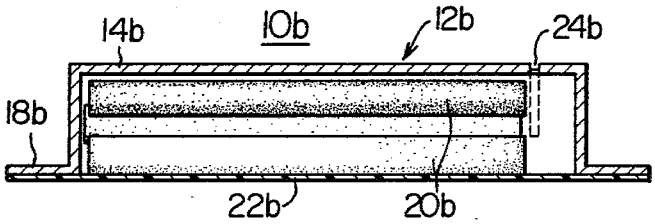
FIG. 9 is a longitudinal sectional view of the package shown in FIG. 8.

A third embodiment 10*b* is shown in FIGS. 8 and 9 wherein the parts similar to those of the first embodiment 10 are designated by similar reference numerals followed by "b". The embodiment 10b is differentiated from the preceding embodiments 10 and 10a in that the cut formed in the swelling 14b to weaken the container 12b is in the form of a groove 24b formed in the outer surface of the swelling 14b to thin the wall of the swelling portion of the container 12b. The groove 24b extends transversely of the longitudinal axis of the swelling 14b and has its opposite ends laterally aligned with but spaced from the lateral grooves 26b formed in the marginal flange 18b. The cut in the form of the lateral groove 24b can advantageously be employed in the case where the container is made from a relatively brittle material or has a relatively thin wall.

Figure 10:
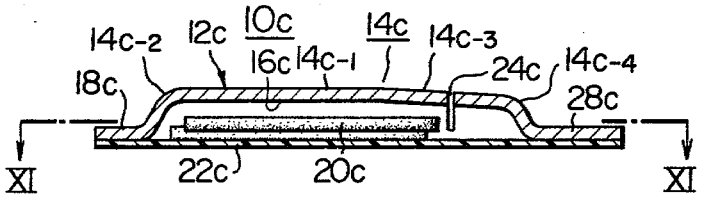
FIG. 10 is a longitudinal sectional view of a fourth embodiment of the package according to the present invention.
Figure 11:
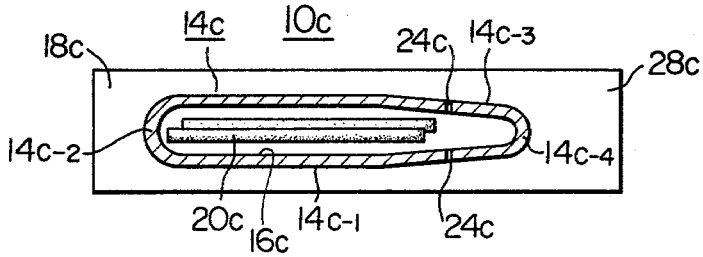
FIG. 11 is a sectional view of the package shown in FIG. 10 as taken along line XI—XI in FIG. 10.
Figure 12:
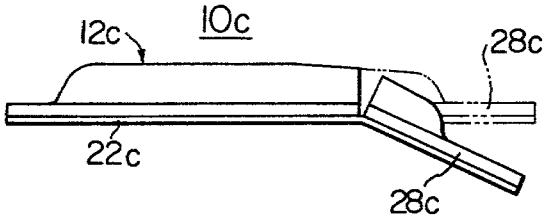
FIG. 12 is a side view of the package shown in FIGS. 10 and 11, package being shown in its opened position.

A fourth embodiment 10c of the present invention is shown in FIGS. 10 to 12 wherein the parts similar to those of the first embodiment 10 are designated by similar reference numerals followed by "c". The difference only will be described hereunder. The elongated swelling 14c has a major portion 14c-1 which is generally semicylindrical in cross-section and which is integrally continuous at one end with a substantially spherical convex end 14c-2 of the swelling 14c. The semi-cylindrical major portion 14c-1 is also integrally continuous at the other end with a convergent portion 14c-3 which converges to the other end 14c-4 of the elongated swelling 14c. The convergent portion 14c-3 has such a shape as to be obtained from a hollow frusto-conical member which is axially divided into two halves; namely, the convergent portion 14c-3 resembles one-half of a hollow frusto-conical member. The other end 14c-4 of the elongated swelling has also substantially spherical convex configuration like that of the first end 14c-2 of the swelling 14c but is smaller than the first end 14c-2. The container-weakening slit 24c is formed in the convergent portion 14c-3.

The embodiment 10c is also provided with the substantially flat wide end 28c. The provision of the convergent portion 14c-3 in the longitudinal swelling 14c has a connection with the provision of the wide end 28c in the package 10c. The reason will be made apparent by the following description.

The embodiment 10c is characterized by the shape of the swelling 14c and by the improved easy shaping or drawing operation. The containers of the first to third embodiments 10a to 10b may easily be made from a plastics sheet material by a conventional shaping or forging method in which the plastics sheet material is first heated to a predetermined temperature and then shaped by means of shaping or molding members. The resultant product has a substantially uniform wall thickness throughout all the sections thereof. However, a sheet metal, which has lower elongation and ductility than those of a plastics sheet, cannot easily be shaped into a container having a uniform wall thickness so long as the container is similar in shape as those of the first to third embodiments 10 to 10b. The design of the fourth embodiment 10c of the present invention enables a sheet metal to be easily shaped or formed into a container 12c having a substantially uniform wall thickness throughout all the sections thereof.

Figure 13:
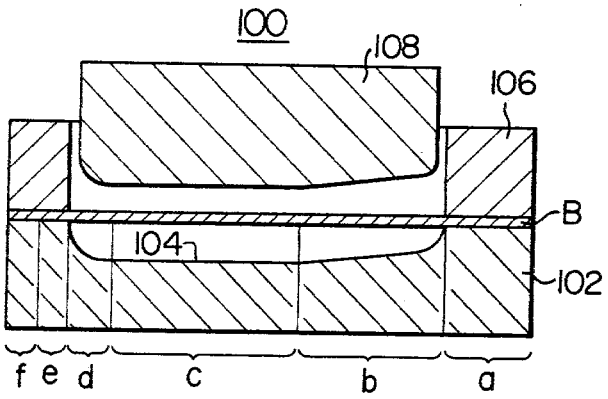
FIG. 13 is a sectional view of a mold used to shape a blank into a container section of the package of the fourth embodiment.

The method of shaping or forming a sheet metal into a container 12c of the fourth embodiment 10c will be discussed with reference to FIG. 13 which illustrates a mold 100 used to perform the method. The mold 100 comprises a female member 102 which defines therein a cavity 104 of a shape the same as that of the outer surface of the swelling 14c of the container 12c. A blank of a sheet metal B is placed over the cavity 104. A gripper frame 106 is urged against the marginal area of the sheet metal B to cooperate with the upper surface of the female member 102 to firmly grip the marginal area of the sheet metal B. Then, a male member 108 of a shape the same as the configuration of the inner surface of the swelling 14c, i.e., the recess 16c, is forced downwardly into the cavity 104 until the sheet metal B is forged into intimate contact with the inner surface of the cavity 104. During this forging operation, respective points of the central zone of the sheet metal B are subjected to elongation. Since the sheet metal B is firmly gripped at its section a (corresponding to the wide end 28 of the final product) between the female mold member 102 and the gripping frame member 106 over a wider area than the area of the sections e and f at which the sheet metal is also gripped by the female mold member 102 and the frame member 106, the material in the section a is not at all subjected to elongation. On the contrary, the material in the sections e and f is subjected to elongation to a smaller extent, so that the material flows from section f to section e and from section e to section d. It will, therefore, be appreciated that, if the swelling 14c were of the uniform width and height all over the entire length of the swelling, the material in the section b of the sheet material B will be subjected to the greatest degree of elongation and thus is reduced to the thinnest wall thickness, which tends to produce cracks in the elongated or drawn material in the section b. With the design of the container 12c of the embodiment 10c, however, the portion 14c-3 which is adjacent to the wide end 28c of the package (i.e., adjacent to the wide section a of the blank B) is gradually reduced in width and height toward the wide end 28c. The material of this portion 14c-3, which corresponds to the section b of the blank B, is subjected to elongation of a reduced degree as compared with the elongation in the case where the portion 14c-3 of the container 12c were of the same width and height as the semi-cylindrical portion 14c-1 of the container. For the reasons discussed above, the container of the fourth embodiment 10c of the invention presents a substantially uniform wall thickness throughout all the areas and sections thereof.

Figure 14:
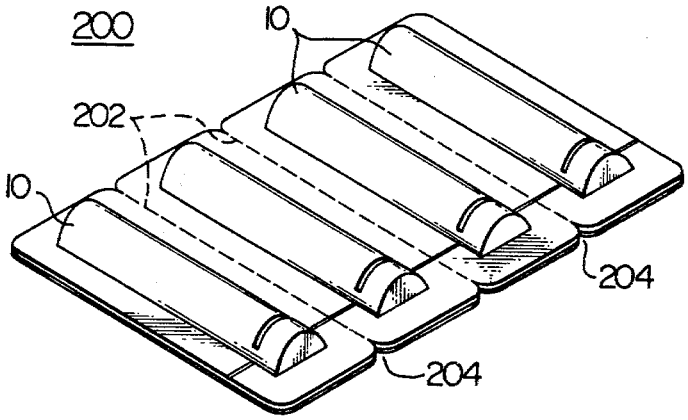
FIG. 14 is a perspective view of a multiple package unit which comprises a plurality of packages of the first embodiment of the invention shown in FIGS. 1 to 3.

FIG. 14 shows a multiple package unit 200 which consists of a plurality of packages of mechanical pencil refill leads 10 of the first embodiment described with reference to FIGS. 1 to 4. The packages 10 are arranged in side-by-side relationship and integrally connected along their sides. The unit 200 is made from a pair of sheet materials one of which is so shaped as to provide a plurality of flanged swellings on one side and corresponding recesses in the other side. Mechanical pencil refill leads (not shown) are disposed in respective recesses. The one sheet material includes a plurality of sections divided by weakening lines 202 in the form of score lines which extend between adjoining flanges of respective containers. Stated in other words, the sections of the one sheet material form a plurality of integral but easily separable containers. The second sheet material is substantially flat and continuous and includes a plurality of sections each coextensive with one of the containers and secured to the flange thereof to form a closure of the container. Each of the containers cooperates with the leads (not shown) therein and with the associated closure to form a package 10. The score lines 202 facilitate easy separation of respective packages 10. So as to further facilitate easy separation of packages 10, V-shaped notches 204 are formed along one side edge of the multiple package unit 200 in such a manner that the pointed end of each notch 204 is connected to one of the score lines 202.

The multiple package unit 200 is shown and has been described as consisting of a plurality of the packages 10 of the first embodiment of the invention. However, it will be apparent to those in the art that the package unit 200 may consist of packages of any of the other embodiments 10*a* to 10*c*.

What is claimed is:

1. A package of mechanical pencil refill leads, comprising a container formed of a plastically deformable first sheet material having an elongated recess therein and a substantially flat marginal flange integral with said recess and extending outwardly therefrom, mechanical pencil refill leads disposed in said recess, and a substantially flat closure member of a second sheet material extending over said recess to close said recess, said second sheet material being secured to said marginal flange, wherein said first sheet material includes a slit formed in said recess adjacent to one end thereof to facilitate easy opening of said package, said slit having at least a portion of its length extending obliquely with respect to the longitudinal axis of said recess.

2. A package as defined in claim 1, wherein said container has a generally arcuate cross-section.

3. A package as defined in claim 1 or 2, wherein said marginal flange adjacent to at least one of the ends of said elongated recess is extended in the longitudinal direction of said recess to provide said package with a substantially flat and widened end.

4. A package as defined in claim 3, wherein the portion of said elongated recess adjacent to said substantially flat and widened end of said package is divergent towards said substantially flat and widened package end.

5. A package as defined in claim 1 or 2, wherein said first sheet material is made of aluminium and said second sheet material is made of a transparent plastics material.

6. A multiple package unit including a plurality of packages of mechanical pencil refill leads, comprising a first member of a plastically deformable first sheet material including a plurality of integral parallel sections each shaped to provide an elongated recess therein and a substantially flat marginal flange integral with said recess and extending outwardly therefrom, said sections forming separable containers, respectively, mechanical pencil refill leads disposed in the recess in each of the containers, and a substantially flat second member of a second sheet material including a plurality of substantially flat integral sections each coextensive with one of said containers and secured to the marginal flange of the container to form a closure for the container, each of the containers cooperating with the leads disposed therein and with the associated closure to form a package, at least one of said first and second members being provided with means facilitating easy separation of the packages, the container of each package including a slit formed in said recess adjacent to one end thereof to facilitate easy opening of the package, each of said slits having at least a portion of its length extending obliquely with respect to the longitudinal axis of said recess.

* * * * *